US007735166B1

(12) United States Patent
Weeks

(10) Patent No.: US 7,735,166 B1
(45) Date of Patent: Jun. 15, 2010

(54) HAMMOCK ASSEMBLY AND ASSOCIATED METHOD

(76) Inventor: Jack Weeks, 6097 W. Audrey La., Glendale, AZ (US) 85308

( * ) Notice: Subject to any disclaimer, the term of this patent is extended or adjusted under 35 U.S.C. 154(b) by 0 days.

(21) Appl. No.: 12/157,489

(22) Filed: Jun. 11, 2008

Related U.S. Application Data

(60) Provisional application No. 60/933,844, filed on Jun. 11, 2007.

(51) Int. Cl.
*A45F 3/24* (2006.01)

(52) U.S. Cl. ..... 5/127; 5/120; 5/121; 248/156

(58) Field of Classification Search ..... 5/127, 5/128, 129, 120, 98.3, 121, 122, 123; 135/90, 135/121, 118, 15.1; 52/169.13, 170, 247, 52/301
See application file for complete search history.

(56) References Cited

U.S. PATENT DOCUMENTS 1,159,192 A 11/1915 Dudley
4,125,909 A * 11/1978 Jacobson ..... 5/121
5,572,835 A * 11/1996 Atkins et al. ..... 52/111
5,752,349 A * 5/1998 Fitzsimmons et al. ..... 52/165
6,234,444 B1 * 5/2001 Haddad ..... 248/545
6,409,419 B1 6/2002 Hernandez
6,418,577 B1 7/2002 Murphy
6,467,110 B1 10/2002 Ketcher
6,470,518 B1 10/2002 Ke
6,816,086 B1 * 11/2004 Kieffer, Sr. ..... 340/933
6,934,983 B1 8/2005 Johnston
7,055,807 B2 * 6/2006 Pesta ..... 256/65.14
7,246,929 B2 * 7/2007 Schuster ..... 362/431
2003/0056447 A1 * 3/2003 O'Brien et al. ..... 52/127.2
2007/0131824 A1 * 6/2007 Harold et al. ..... 248/156

* cited by examiner

*Primary Examiner*—Peter M Cuomo
*Assistant Examiner*—Brittany M Wilson

(57) ABSTRACT

A multi-functional hammock assembly for providing user comfort and enjoyment may include first and second elongated rectilinear poles, a hammock, and first and second sleeves slidably positioned about the bottom ends of the first and second poles. The hammock assembly may further include at least one accessory and a mechanism for effectively anchoring the at least one accessory to the first and second poles. The assembly may further include a mechanism for synchronously rotating at least one of the first and second sleeves and the first and second poles about a centrally registered longitudinal axis passing through the one pole to thereby conveniently assist a user to penetrate the one sleeve into a ground surface.

11 Claims, 4 Drawing Sheets

HAMMOCK ASSEMBLY AND ASSOCIATED METHOD

CROSS REFERENCE TO RELATED APPLICATIONS

This application claims the benefit of U.S. Provisional Application No. 60/933,844, filed Jun. 11, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to hammocks and, more particularly, to a multi-functional hammock assembly for providing user comfort and enjoyment.

2. Prior Art

Hammocks are usually supported by a framework holding each end of the hammock, with the framework having a plurality of feet, bars or other support structure supporting the framework on solid ground. It is generally accepted that the origins of the hammock began nearly 1,000 years ago in Central America by the Mayan Indians. Today, approximately 500,000 to 2,000,000 hammocks are sold yearly in North America. Incredibly, very few changes in hammock design have occurred over the last 1,000 years. However, the present invention is designed to permit easy use and transport of hammocks.

Hammocks are normally attached to, and supported by, two adjacent trees or two poles inserted into the ground. When poles or stakes are used as hammock supports the process of constructing the hammock can be tedious and unrewarding. In many cases, the poles simply do not provide ample support for one or two persons to lounge in the hammock. Further, inserting poles or stakes into the ground and attaching guidelines is not an easy task.

As evidenced by relevant hammock patents, needed is a hammock easy to configure, transport and capable of use in alternative locations. Many U.S. Patents covering hammocks and their design issued prior to 1950. The older filed and issued patents confirm that relatively few novel changes have been made to hammocks over the past half century.

U.S. Pat. No. 6,467,110 to Ketcher discloses a hammock and support system which uses a simple boat dock post and dock structure to support the entire weight of a hammock and person lying in the hammock. Unfortunately, this prior art example requires a dock structure that must be moved periodically in order to prevent damage to the ground area.

U.S. Pat. No. 6,409,419 to Hernandez discloses a removable post assembly for securing an area comprising an anchorage assembly, an elongated post member and a locking assembly to lock and secure the removable post member to the anchorage assembly. The anchorage assembly includes housing with an upper opening adjacent to the ground level to cooperatively receive a portion of the elongated post member. The housing has cavities or bay members to selectively receive a latching member of the locking assembly. Unfortunately, again, this prior art example requires an anchorage assembly that must be moved periodically in order to prevent damage to the grass and ground area.

U.S. Pat. No. 1,159,192 to Dudley discloses a combined clothes line and hammock support to provide a support which may be quickly and easily put up or taken down when desired. Unfortunately, this prior art example does not provide a means for added attachments such as an umbrella-type top for shade.

Accordingly, the present invention is disclosed in order to overcome the above noted shortcomings. The hammock assembly is convenient and easy to use, lightweight yet durable in design, and designed for providing user comfort and enjoyment. The assembly is simple to use, inexpensive, and designed for many years of repeated use.

BRIEF SUMMARY OF THE INVENTION

In view of the foregoing background, it is therefore an object of the present invention to provide an apparatus for providing user comfort and enjoyment. These and other objects, features, and advantages of the invention are provided by a hammock assembly.

A multi-functional hammock assembly for providing user comfort and enjoyment may include first and second elongated rectilinear poles with axially opposed top and bottom ends respectively. Such first and second poles are preferably oriented substantially parallel to each other. The assembly may further include a hammock provided with a plurality of anchor members affixed to the first and second poles such that the hammock is supported above the bottom ends of the first and second poles respectively.

The hammock assembly further preferably includes first and second sleeves slidably positioned about the bottom ends of the first and second poles. Such first and second sleeves may have a plurality of ridges protruding outwardly from an outer surface thereof respectively. Each of the first and second sleeves conveniently and preferably includes a linear slit formed therein and extending downwardly from an open top end of the first and second sleeves. Such a slit may terminate above a bottom end of the first and second sleeves. The sleeve may further include a threaded cap removably mated to an open top end thereof when the sleeve is detached from the bottom end of the pole.

The hammock assembly may further include at least one accessory for use with the multi-functional hammock assembly. Such an at least one accessory preferably includes a television and a tray and a canopy and a fan coupled to associated ones of the first and second poles respectively.

The assembly may further include a mechanism for effectively anchoring the at least one accessory to the first and second poles such that the at least one accessory is preferably maintained at a substantially stable position. Such an anchoring mechanism preferably includes a plurality of brackets directly connected to the television and the tray and the fan respectively. Such brackets may further be directly connected to the first pole respectively. The anchoring mechanism further includes a support lever preferably having first and second linear arms pivotally coupled to each other. Such a first linear arm may be slidably interfitted into the top end of the pole, and such a second linear arm may protrude outwardly from the first linear arm and terminate at a predetermined distance therefrom. The canopy is preferably positioned over the second linear arm and may further be disposed along a substantially horizontal plane oriented parallel to the second linear arm.

The assembly may further include a mechanism for synchronously rotating at least one of the first and second sleeves and the first and second poles about a centrally registered longitudinal axis passing through the one pole to thereby conveniently assist a user to penetrate the one sleeve into a ground surface. Such a synchronously rotating mechanism preferably includes a spool concentrically mounted about the bottom end of the one pole. Such a spool may have a corrugated outer circumference provided with a plurality of angularly offset shoulders extending therealong. Such shoulders are preferably equidistantly spaced from a center of the spool respectively, and a bracket may be statically affixed to the outer surface of the one sleeve. The mechanism may further include a primary lever having a non-linear shape and pivotally coupled to the bracket while remaining spaced from the one sleeve, a first auxiliary lever with a linear shape provided having axially opposed ends pivotally coupled to the primary lever and removably seated against selected ones of the shoulders, and a second auxiliary lever having a linear shape provided with axially opposed ends pivotally coupled to the primary lever and removably abutted against other ones of the shoulders. A reciprocating rotational articulation of the primary lever along a first arcuate path causes the first and second auxiliary levers to selectively exert a tangential force against the shoulders and thereby cause the spool to rotate along a second arcuate path that is mutually exclusive of the first arcuate path.

The present invention further includes a method for using a multi-functional hammock assembly and providing user comfort and enjoyment. Such a method preferably includes the steps of: providing first and second elongated rectilinear poles having axially opposed top and bottom ends respectively; orienting the first and second poles substantially parallel to each other; providing a hammock having a plurality of anchor members; affixing the anchor members to the first and second poles; supporting the hammock above the bottom ends of the first and second poles respectively; providing and slidably positioning first and second sleeves about the bottom ends of the first and second poles, the first and second sleeves having a plurality of ridges protruding outwardly from an outer surface thereof respectively; providing and using at least one accessory with the multi-functional hammock assembly; and anchoring the at least one accessory to the first and second poles such that the at least one accessory is maintained at a substantially stable position.

The method preferably further includes the steps of: synchronously rotating at least one of the first and second sleeves and the first and second poles about a centrally registered longitudinal axis passing through the one pole; and penetrating the one sleeve into a ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
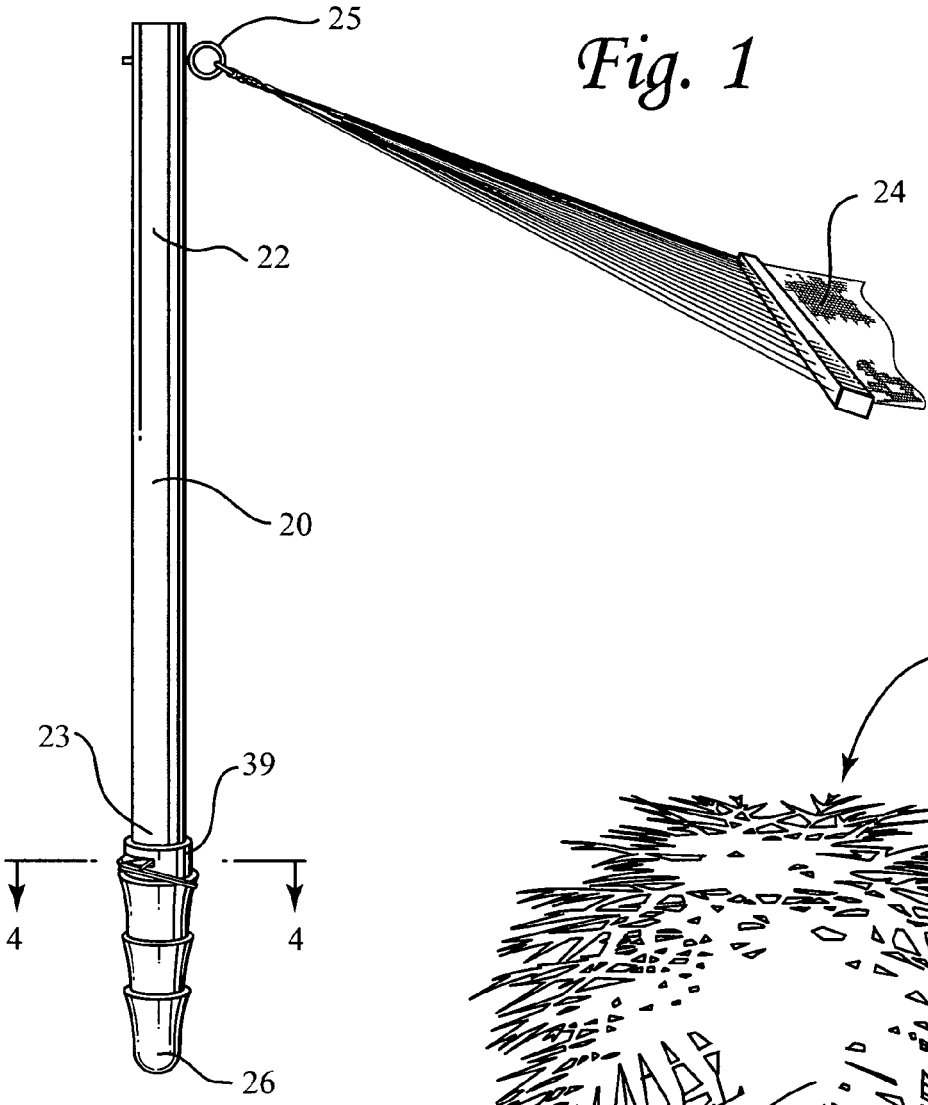
FIG. 1 is a perspective view showing a pole interfitted with a synchronously rotating mechanism and sleeve, in accordance with the present invention.
Figure 2:
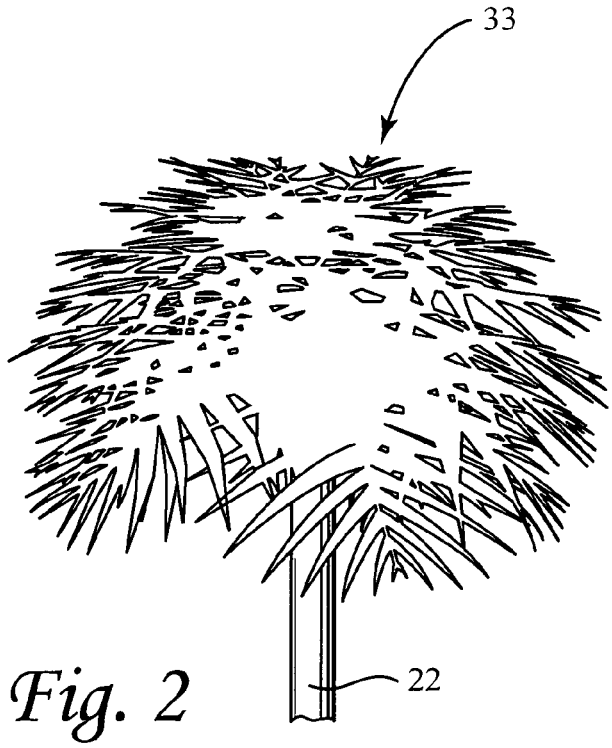
FIG. 2 is a perspective view of a decorative accessory.
Figure 3:
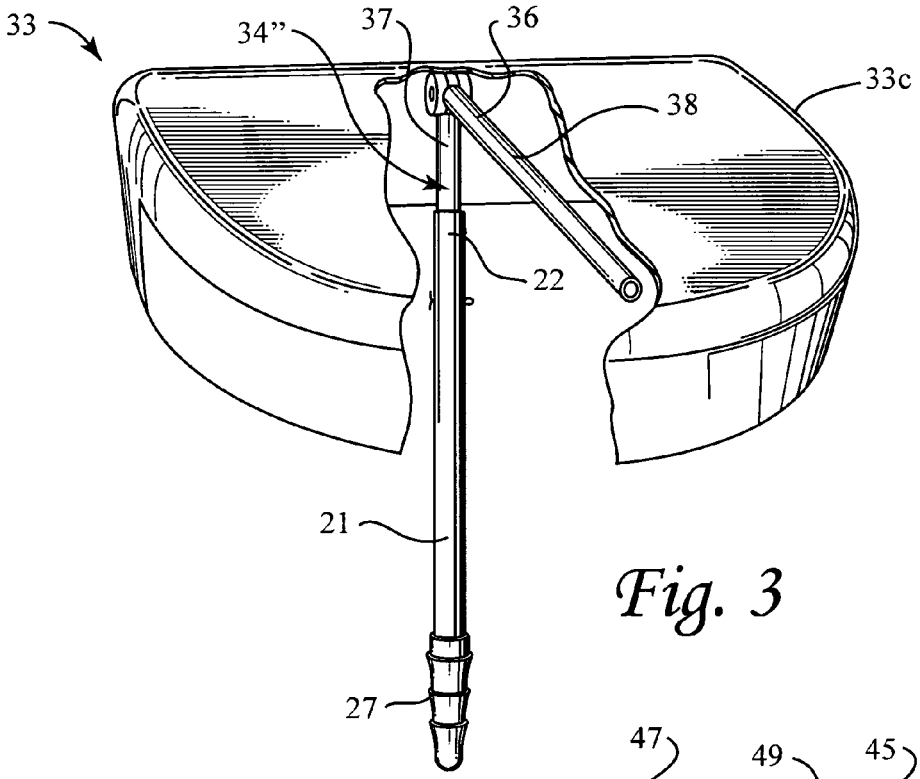
FIG. 3 is a perspective view of a canopy accessory with a breakaway view of an anchoring mechanism.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-8 by the reference numeral 10 and is intended to provide a hammock assembly. It should be understood that the assembly 10 may be used to accommodate many different types of hammocks and should not be limited to accommodating only those types of hammocks mentioned herein.

Figure 5A:
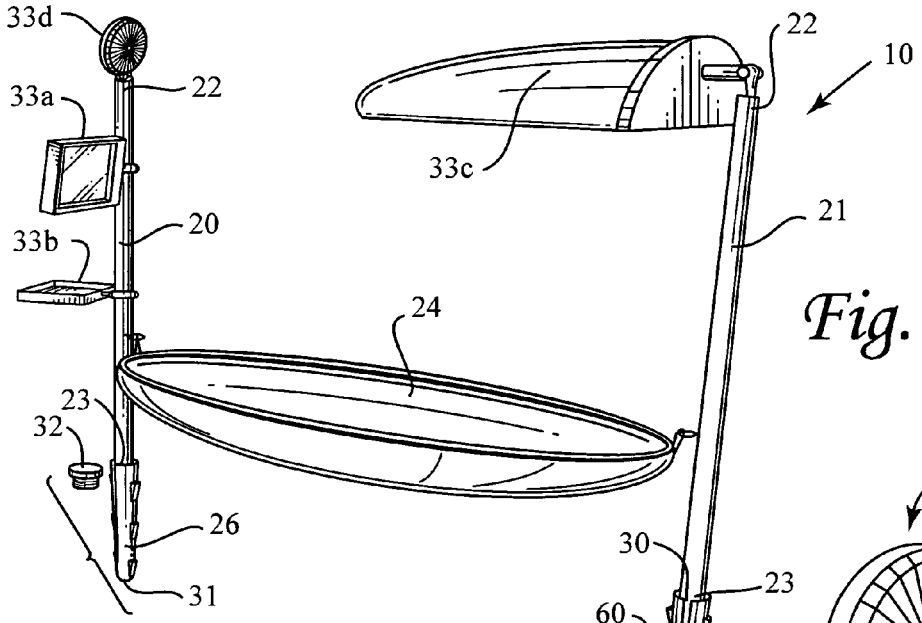
FIG. 5*a* is a perspective view of the multi-functional hammock assembly, in accordance with the present invention.
Figure 5B:
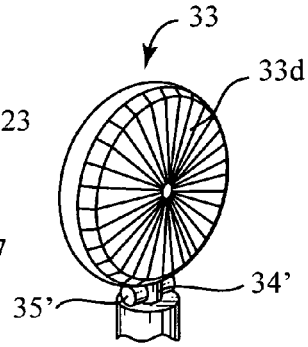
FIG. 5*b* is an enlarged view of a fan accessory, as seen in FIG. 5*a;*
Figure 5C:
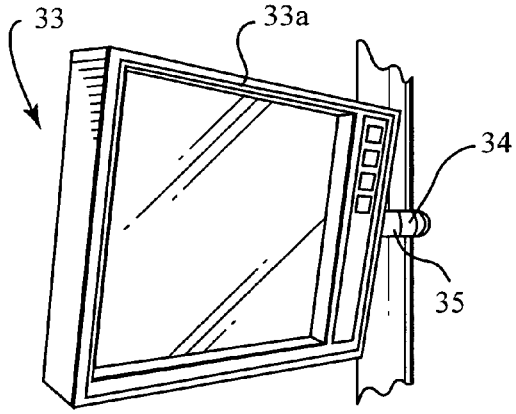
FIG. 5*c* is an enlarged view of a television accessory, as seen in FIG. 5*a;*
Figure 5D:
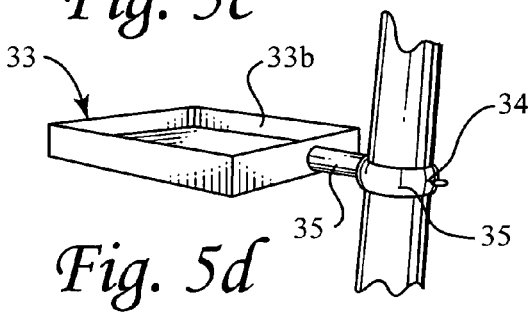
FIG. 5*d* is an enlarged view of a tray accessory, as seen in FIG. 5*a;*
Figure 5E:
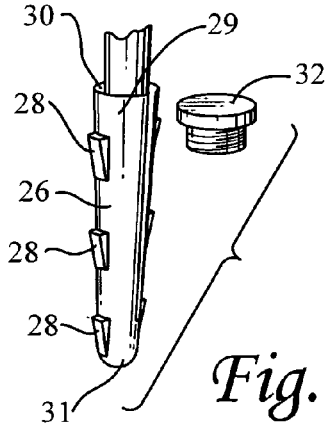
FIG. 5*e* is an enlarged view of the sleeve and threaded cap respectively, as seen in FIG. 5*a;*
Figure 6:
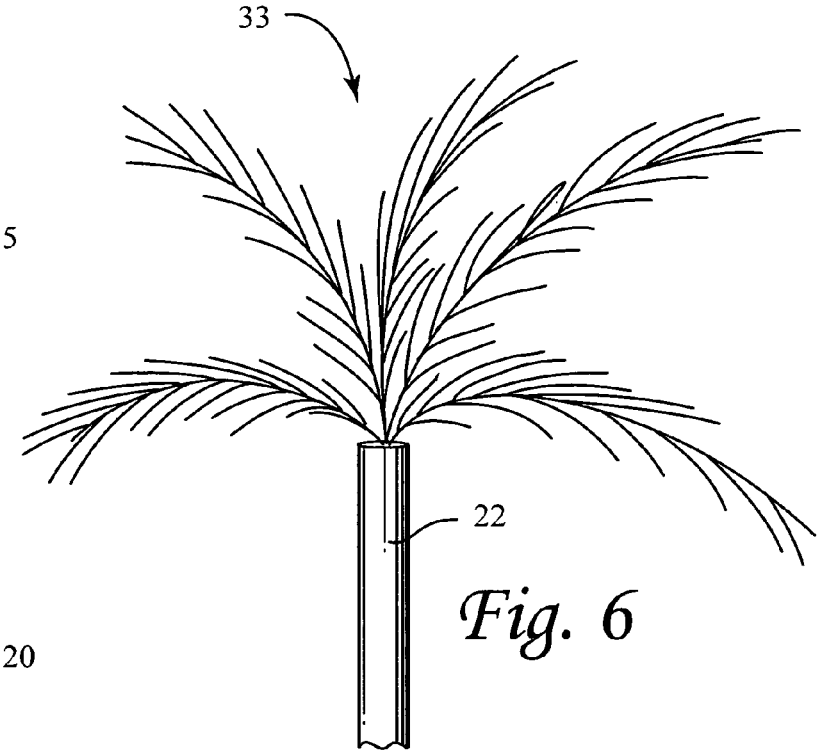
FIG. 6 is a perspective view of another decorative accessory.
Figure 7:
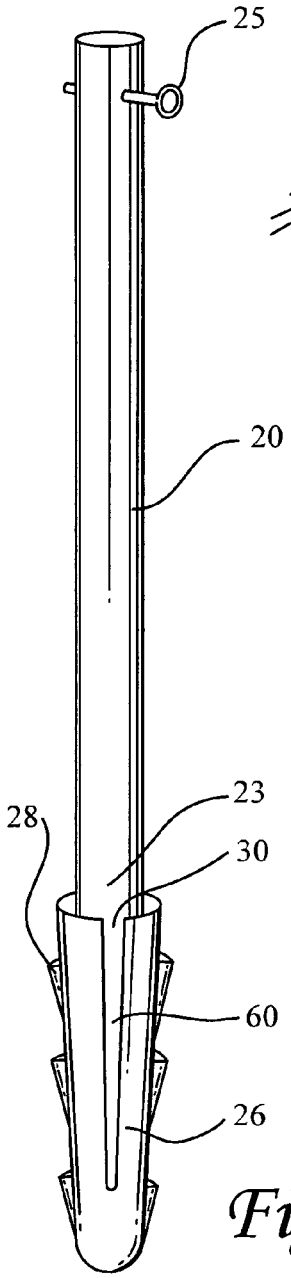
FIG. 7 is an enlarged view of the pole and sleeve.
Figure 8:
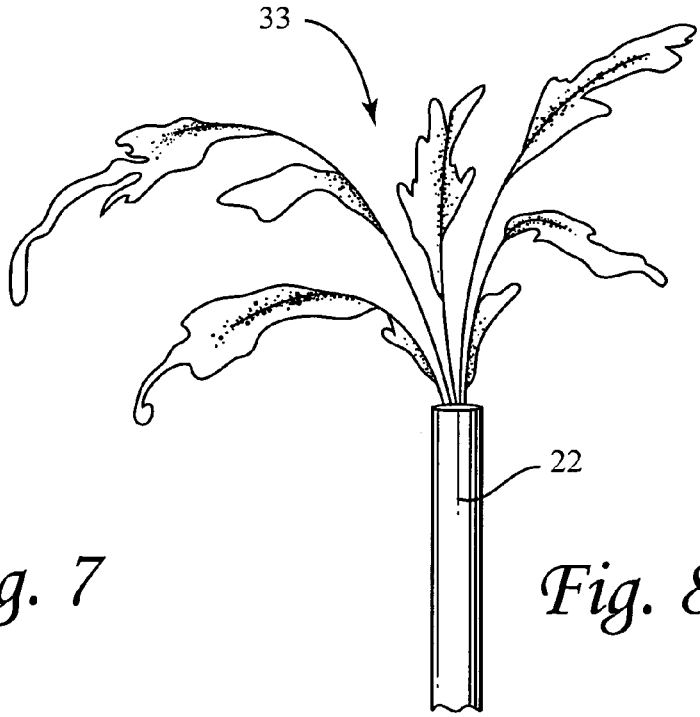
FIG. 8 is a perspective view of yet another decorative accessory.

Referring initially to FIGS. 1 and 5*a*, a multi-functional hammock assembly 10 for providing user comfort and enjoyment may include first and second elongated rectilinear poles 20, 21 with axially opposed top and bottom ends 22, 23 respectively. Such first and second poles 20, 21 are preferably oriented substantially parallel to each other. The assembly 10 may further include a hammock 24 provided with a plurality of anchor members 25 affixed to the first and second poles 20, 21 which is important such that the hammock 24 is supported above the bottom ends 23 of the first and second poles 20, 21 respectively. The combination of the first and second poles and hammock provides an unpredictable and unexpected result which is not rendered obvious by one skilled in the art because the hammock may advantageously be selectively removed from the first and second poles as needed by a user.

Referring to FIGS. 1, 5*a*, 5*e* and 7, the hammock assembly 10 further preferably includes first and second sleeves 26, 27 slidably positioned about the bottom ends 23 of the first and second poles 20, 21. Such first and second sleeves 26, 27 may have a plurality of ridges 28 protruding outwardly from an outer surface 29 thereof respectively. Each of the first and second sleeves 26, 27 conveniently and preferably includes a linear slit 60 formed therein and extending downwardly from an open top end 30 of the first and second sleeves 26, 27. Such a slit 60 may terminate above a bottom end 31 of the first and second sleeves 26, 27. The sleeve 26, 27 may further include a threaded cap 32 removably mated to an open top end 30 thereof when the sleeve 26, 27 is detached from the bottom end 23 of the pole 20, 21. The combination of the first and second sleeves and ridges provides an unpredictable and unexpected result which is not rendered obvious by one skilled in the art because the ridges prevent the sleeves from inadvertently becoming disengaged from a ground surface and thereby providing a better anchoring system for the first and second poles.

Referring to FIGS. 2, 5*a*, 5*b*, 5*d*, 6 and 8, the hammock assembly 10 may further include at least one accessory 33 for use with the multi-functional hammock assembly 10. Such an at least one accessory 33 preferably includes a television 33A and a tray 33B and a canopy 33C and a fan 33D coupled to associated ones of the first and second poles 20, 21 respectively. The accessories advantageously provide a user with multiple decorative and entertaining customizations.

Referring to FIGS. 3 and 5*a* through 5*e*, the assembly 10 may further include a mechanism 34, 34', 34" for effectively anchoring the at least one accessory 33 to the first and second poles 20, 21 which is vital such that the at least one accessory 33 is preferably maintained at a substantially stable position. Such an anchoring mechanism 34, 34', 34" preferably includes a plurality of brackets 35, 35' directly connected, without the use of intervening elements, to the television 33A and the tray 33*b* and the fan 33D respectively. Such brackets 35, 35' may further be directly connected, without the use of intervening elements, to the first pole 20 respectively.

The anchoring mechanism 34, 34', 34" further includes a support lever 36 preferably having first and second linear arms 37, 38 pivotally coupled to each other. Such a first linear arm 37 may be slidably interfitted into the top end of the pole 22, and such a second linear arm 38 may protrude outwardly from the first linear arm 37 and terminate at a predetermined distance therefrom. The canopy 33C is preferably positioned over the second linear arm 38 and may further be disposed along a substantially horizontal plane oriented parallel to the second linear arm 38. The combination of the brackets, in use with the various accessories, provides an unpredictable and unexpected benefit of enabling a user to choose only those accessories which suit their individual needs.

Figure 4A:
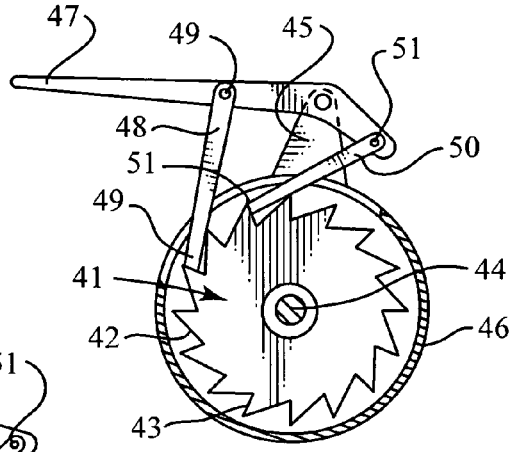
FIG. 4*a* is a cross sectional view of a synchronously rotating mechanism, as seen in FIG. 1.
Figure 4B:
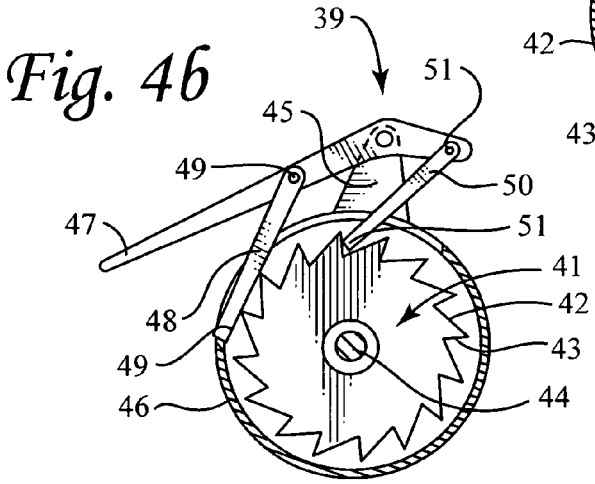
FIG. 4*b* is a cross sectional view of the synchronously rotating mechanism in an engaged position.

Referring to FIGS. 1, 4*a* and 4*b*, the assembly 10 may further include a mechanism 39 for synchronously rotating at least one of the first and second sleeves 26, 27 and the first and second poles 20, 21 about a centrally registered longitudinal axis passing through the one pole 20, 21 to thereby conveniently assist a user to penetrate the one sleeve 26, 27 into a ground surface. Such a synchronously rotating mechanism 39 preferably includes a spool 41 concentrically mounted about the bottom end 23 of the one pole 20, 21. Such a spool 41 may have a corrugated outer circumference 42 provided with a plurality of angularly offset shoulders 43 extending thereal-ong. Such shoulders 43 are preferably equidistantly spaced from a center 44 of the spool 41 respectively, and a bracket 45 may be statically affixed to the outer surface 46 of the one sleeve 26, 27.

The mechanism 39 may further include a primary lever 47 having a non-linear shape and pivotally coupled to the bracket 45 while remaining spaced from the one sleeve 26, 27, a first auxiliary lever 48 with a linear shape provided having axially opposed ends 49 pivotally coupled to the primary lever 47 and removably seated against selected ones of the shoulders 43, and a second auxiliary lever 50 having a linear shape provided with axially opposed ends 51 pivotally coupled to the primary lever 47 and removably abutted against other ones of the shoulders 43.

A reciprocating rotational articulation of the primary lever 47 along a first arcuate path causes the first and second auxiliary levers 48, 50 to selectively exert a tangential force against the shoulders 43 and thereby cause the spool 41 to rotate along a second arcuate path that is mutually exclusive of the first arcuate path. The synchronously rotating mechanism provides an unpredictable and unexpected benefit of causing the pole to rotate and thereby allow the user to penetrate the sleeve into a hard or tough ground surface without exerting excess effort, thus providing better support for the pole.

In use, the present invention includes a method for using a multi-functional hammock assembly 10 and providing user comfort and enjoyment. Such a method preferably includes the steps of: providing first and second elongated rectilinear poles 20, 21 having axially opposed top and bottom ends 22, 23 respectively; orienting the first and second poles 20, 21 substantially parallel to each other; providing a hammock 24 having a plurality of anchor members 25; affixing the anchor members 25 to the first and second poles 20, 21; supporting the hammock 24 above the bottom ends 23 of the first and second poles 20, 21 respectively; providing and slidably positioning first and second sleeves 26, 27 about the bottom ends 23 of the first and second poles 20, 21, the first and second sleeves 26, 27 having a plurality of ridges 28 protruding outwardly from an outer surface 29 thereof respectively; providing and using at least one accessory 33 with the multi-functional hammock assembly 10; and anchoring the at least one accessory 33 to the first and second poles 20, 21 such that the at least one accessory 33 is maintained at a substantially stable position.

In use, the method preferably further includes the steps of: synchronously rotating at least one of the first and second sleeves 26, 27 and the first and second poles 20, 21 about a centrally registered longitudinal axis passing through the one pole 20/21; and penetrating the one sleeve 26/27 into a ground surface.

The present invention, as claimed, provides the unexpected and unpredictable benefit of a multifunctional hammock assembly, which may include a removable support for a hammock. The assembly may further include first and second poles with first and second sleeves located at the bottom end of the first and second pole for temporarily removing the first and second pole in the case of lawn maintenance procedures or other situations where the first and second pole may need to be relocated. The poles may of course be manufactured in a variety of shapes, colors and sizes according to the user's preferences.

The assembly may also provide an anchor member located on the upper portion of the first and/or second pole in order to allow a hammock to be secured to the structure. The first and second pole may further be designed to allow additional structures to be added to the assembly. The poles may be hollow posts that are preferably designed for an anchoring mechanism to be inserted and thereby held upright. Such an anchoring mechanism may be alternately designed to include either a canopy or other accessory.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multi-functional hammock assembly for providing user comfort and enjoyment, said multi-functional hammock assembly comprising:

first and second poles having opposed top and bottom ends respectively, said first and second poles being oriented substantially parallel to each other;

a hammock provided with a plurality of anchor members affixed to said first and second poles such that said hammock is supported above said bottom ends of said first and second poles respectively;

first and second sleeves positioned about said bottom ends of said first and second poles, said first and second sleeves having a plurality of ridges protruding outwardly from an outer surface thereof respectively;

at least one accessory for use with said multi-functional hammock assembly;

means for anchoring said at least one accessory to said first and second poles such that said at least one accessory is maintained at a substantially stable position; and means for synchronously rotating at least one of said first and second sleeves and said first and second poles about a centrally registered longitudinal axis passing through said one pole to thereby assist a user to penetrate said one sleeve into a ground surface.

2. The multi-functional hammock assembly of claim 1, wherein said synchronously rotating means comprises:

a spool concentrically mounted about said bottom end of said one pole, said spool having a corrugated outer circumference provided with a plurality of angularly offset shoulders extending therealong, said shoulders being equidistantly spaced from a center of said spool respectively;

a bracket statically affixed to said outer surface of said one sleeve;

a primary lever having a non-linear shape and being pivotally coupled to said bracket while remaining spaced from said one sleeve;

a first auxiliary lever having a linear shape provided with axially opposed ends pivotally coupled to said primary lever and removably seated against selected ones of said shoulders; and a second auxiliary lever having a linear shape provided with axially opposed ends pivotally coupled to said primary lever and removably abutted against other ones of said shoulders;

wherein a reciprocating rotational articulation of said primary lever along a first arcuate path causes said first and second auxiliary levers to selectively exert a tangential force against said shoulders and thereby cause said spool to rotate along a second arcuate path that is mutually exclusive of said first arcuate path.

3. The multi-functional hammock assembly of claim 1, wherein said at least one item selected from the group including a television and a tray and a canopy and a fan coupled to associated ones of said first and second poles respectively.

4. The multi-functional hammock assembly of claim 3, wherein said anchoring means comprises: a plurality of brackets directly connected to said television and said tray and said fan respectively, said brackets further being directly connected to said first pole respectively.

5. The multi-functional hammock assembly of claim 3, wherein said anchoring means further comprises: a support lever having first and second linear arms pivotally coupled to each other, said first linear arm being slidably interfitted into said top end of said pole, said second linear arm protruding outwardly from said first linear arm and terminating at a predetermined distance therefrom;

wherein said canopy is positioned over said second linear arm and is disposed along a substantially horizontally plane oriented parallel to said second linear arm.

6. A multi-functional hammock assembly for providing user comfort and enjoyment, said multi-functional hammock assembly comprising:

first and second elongated rectilinear poles having axially opposed top and bottom ends respectively, said first and second poles being oriented substantially parallel to each other;

a hammock provided with a plurality of anchor members affixed to said first and second poles such that said hammock is supported above said bottom ends of said first and second poles respectively;

first and second sleeves slidably positioned about said bottom ends of said first and second poles, said first and second sleeves having a plurality of ridges protruding outwardly from an outer surface thereof respectively;

at least one accessory for use with said multi-functional hammock assembly;

means for anchoring said at least one accessory to said first and second poles such that said at least one accessory is maintained at a substantially stable position; and means for synchronously rotating at least one of said first and second sleeves and said first and second poles about a centrally registered longitudinal axis passing through said one pole to thereby assist a user to penetrate said one sleeve into a ground surface.

7. The multi-functional hammock assembly of claim 6, wherein said synchronously rotating means comprises:

a spool concentrically mounted about said bottom end of said one pole, said spool having a corrugated outer circumference provided with a plurality of angularly offset shoulders extending therealong, said shoulders being equidistantly spaced from a center of said spool respectively;

a bracket statically affixed to said outer surface of said one sleeve;

a primary lever having a non-linear shape and being pivotally coupled to said bracket while remaining spaced from said one sleeve;

a first auxiliary lever having a linear shape provided with axially opposed ends pivotally coupled to said primary lever and removably seated against selected ones of said shoulders; and a second auxiliary lever having a linear shape provided with axially opposed ends pivotally coupled to said primary lever and removably abutted against other ones of said shoulders;

wherein a reciprocating rotational articulation of said primary lever along a first arcuate path causes said first and second auxiliary levers to selectively exert a tangential force against said shoulders and thereby cause said spool to rotate along a second arcuate path that is mutually exclusive of said first arcuate path.

8. The multi-functional hammock assembly of claim 6, wherein said at least one item selected from the group including a television and a tray and a canopy and a fan coupled to associated ones of said first and second poles respectively.

9. The multi-functional hammock assembly of claim 8, wherein said anchoring means comprises: a plurality of brackets directly connected to said television and said tray and said fan respectively, said brackets further being directly connected to said first pole respectively.

10. The multi-functional hammock assembly of claim 9, wherein said anchoring means further comprises: a support lever having first and second linear arms pivotally coupled to each other, said first linear arm being slidably interfitted into said top end of said pole, said second linear arm protruding outwardly from said first linear arm and terminating at a predetermined distance therefrom;

wherein said canopy is positioned over said second linear arm and is disposed along a substantially horizontally plane oriented parallel to said second linear arm.

11. A method for using a multi-functional hammock assembly and providing user comfort and enjoyment, said method comprising the steps of:

a. providing first and second elongated rectilinear poles having axially opposed top and bottom ends respectively;

b. orienting said first and second poles substantially parallel to each other;

c. providing a hammock having a plurality of anchor members;

d. affixing said anchor members to said first and second poles;

e. supporting said hammock above said bottom ends of said first and second poles respectively;

f. providing and slidably positioning first and second sleeves about said bottom ends of said first and second poles, said first and second sleeves having a plurality of ridges protruding outwardly from an outer surface thereof respectively;

g. providing and using at least one accessory with said multi-functional hammock assembly;

h. anchoring said at least one accessory to said first and second poles such that said at least one accessory is maintained at a substantially stable position;

i. synchronously rotating at least one of said first and second sleeves and said first and second poles about a centrally registered longitudinal axis passing through said one pole; and j. penetrating said one sleeve into a ground surface.

* * * * *